US005983814A

United States Patent [19]

Block

[11] Patent Number: 5,983,814

[45] Date of Patent: Nov. 16, 1999

[54] AUTOMATIC MATTRESS HANDLE SEWING WORK STATION

[75] Inventor: Charles Block, North Bellmore, N.Y.

[73] Assignee: Galkin Automated Products, Hicksville, N.Y.

[21] Appl. No.: 09/037,810

[22] Filed: Mar. 10, 1998

[51] Int. Cl.[6] ..... D05B 11/00; D05B 35/06

[52] U.S. Cl. ..... 112/2.1; 112/470.33

[58] Field of Search ..... 112/2.1, 10, 470.33, 112/470.34

[56] References Cited

U.S. PATENT DOCUMENTS 1,731,530 10/1929 Goldeen et al. ..... 112/2.1
4,527,491 7/1985 Block et al. ..... 112/470.33 X
5,588,384 12/1996 Miyachi et al. ..... 112/470.34 X
5,738,029 4/1998 Porter et al. ..... 112/2.1 X

*Primary Examiner*—Ismael Izaguirre
*Attorney, Agent, or Firm*—Paul J. Sutton

[57] ABSTRACT

An automatic mattress handle sewing workstation is employed to install cloth handles to an mattress border two at a time. A flat handle is placed in a pair of twirler clamps which turn the ends of the handle 180° to underlie the remainder of the handle. The twirler clamps are now moved to place two handles in a position under first and second sewing heads and above the web of mattress border. Clamps hold the positions of the handles while the twirler clamps are withdrawn. The left end of each of the two handles is now sewed to the border. The right ends of the handles are then transferred to the sewing heads. A clamp engages the right side of the handle and the right end of the handle is sewn to the border.

17 Claims, 7 Drawing Sheets

AUTOMATIC MATTRESS HANDLE SEWING WORK STATION

BACKGROUND OF THE INVENTION

1. Field of the Invention

The invention pertains to the construction of mattresses and more particularly to the attachment of cloth handles to the mattress border at selected positions along such border.

2. Description of the Prior Art

To permit mattresses to be shifted on a bed frame or box spring or turned over or rotated it has been common practice to provide two handles on each long side of the mattress by which the mattress could be lifted, shifted, revolved or turned-over. A first type of handle is a loop of braided material extending through two eyelets in the mattress border. The ends of the loop were tied in knots behind the eyelets. Once pulled out for use, these handles extended above the border surface and created an unsightly bulge in the bedding placed over the mattress.

Currently, thin, flat mattress handles are in use which lay flat along the surface of the mattress border when not in use and which can be extended from the surface of the mattress border for use. The handles are sewn at both ends to the mattress border and provide a hand grip area between the sewn ends. The application of bedding over the mattress flattens these cloth handles against the mattress border and no unsightly bulge is created. At present each of the mattress handles is sewn on to the mattress border individually making the use of cloth handles more expensive then previously available handle systems.

SUMMARY OF THE INVENTION

The instant invention overcomes the difficulties noted above with respect to braided mattress handles and cloth handles by providing an automatic workstation for attaching cloth handles at selected positions along a mattress border. A continuous web of mattress border is fed into one end of the workstation and along a work table by means of take-up rollers. Clamping means keep the mattress border in contact with the work table and hold the border taught except when the web is advanced. Two sewing stations are provided above the work table and spaced so that the two handles for one side of the mattress are sewed on at the same time. Automatic handle feeding systems, take cloth handles, roll-over the ends and insert same below the respective sewing heads. Clamps fix the positions of the handles with respect to the mattress border and sewing is initiated. Upon completion, the mattress border is advanced until the portion of the mattress border that will be on the opposite side of the mattress is in the sewing stations. Once both sets of double handles have been attached, the border is advanced and cut-off of the web for use.

It is an object of the instant invention to provide a novel automatic mattress handle sewing workstation.

It is an object of the instant invention to provide a novel automatic mattress handle sewing workstation that requires a minimum of operator function.

It is an object of the instant invention to provide a novel automatic handle forming and insertion system for an automatic mattress handle sewing workstation.

It is another object of the invention to provide slack in a web of mattress border to permit free movement of the border during sewing.

It is still another object of the invention to provide slack for a mattress handle as it is being sewn to a mattress border.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 7:
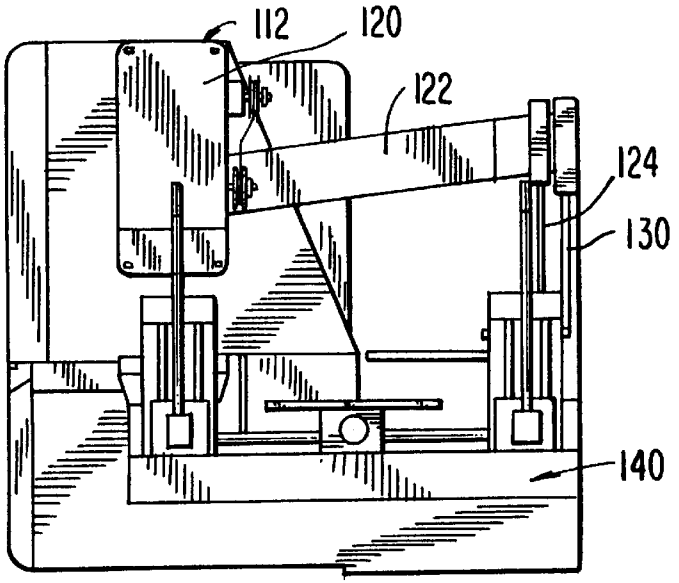
FIG. 7 is a front view of a portion of the workstation of FIG. 5 showing the installation finger assembly with the finger clamps in their initial position.
Figure 2:
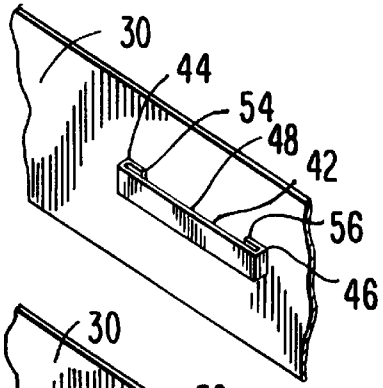
FIG. 2 is top perspective view of cloth handle positioned atop a mattress border.
Figure 3:
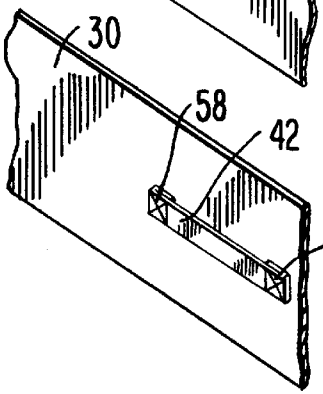
FIG. 3 is similar to FIG. 2 except that the cloth handle has been sewed to the mattress border.
Figure 1:
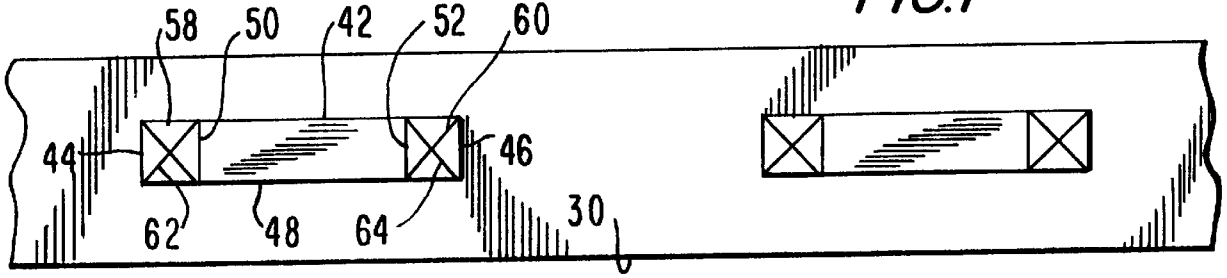
FIG. 1 is a top plan view of length of a mattress border with two cloth handles installed according to the concepts of the invention.

In the usual manner of constructing a mattress, a top panel and a bottom panel are joined to an inner spring unit. The space between the top panel and bottom panel and flanking the edges of the spring unit along two parallel sides and two parallel ends is covered by a mattress border which is sewed to the top and bottom panels to complete the mattress. Turning now to FIGS. 1 to 4 there is shown a portion of a mattress border 30 having two side panels 32, 34 extending in parallel with a central longitudinal axis of a mattress (not shown). A first end panel 36 and a second end panel 38, perpendicular to the longitudinal axis complete the mattress border 30 (see FIG. 4). Positions of the second end panel 38 can be made to overlap as at 40 to facilitate assembly of the border 30 ends (not shown). The cloth handles 42 are sewn to the border 30 in such a manner as to provide strength at the joints. The mattress border 30 is fabricated of two layers of cloth separated by a foam layer and stitched along its top and bottom edges.

The cloth handles 42 are formed from a folded strip of cloth seamed down to the center appear as a flattened tube. The ends of the handles 42 are thus open and could ravel and looks unfinished. The cloth handles 42 have a first end 44, a second end 46 and a grip portion 48 there between. To provide a finished look to the cloth handles 42 and to provide a stronger joint, it has been found that the ends 44, 46 of the handles 42 should be folded back as at 54, 56 respectively to give a two layer region adjacent the ends 50, 52 of the grip portion 48 (see FIG. 2). The double areas 58, 60 are now sewn to the mattress border 30 using a box and cross seam, as shown at 62, 64 in FIGS. 1 and 3.

Figure 4:
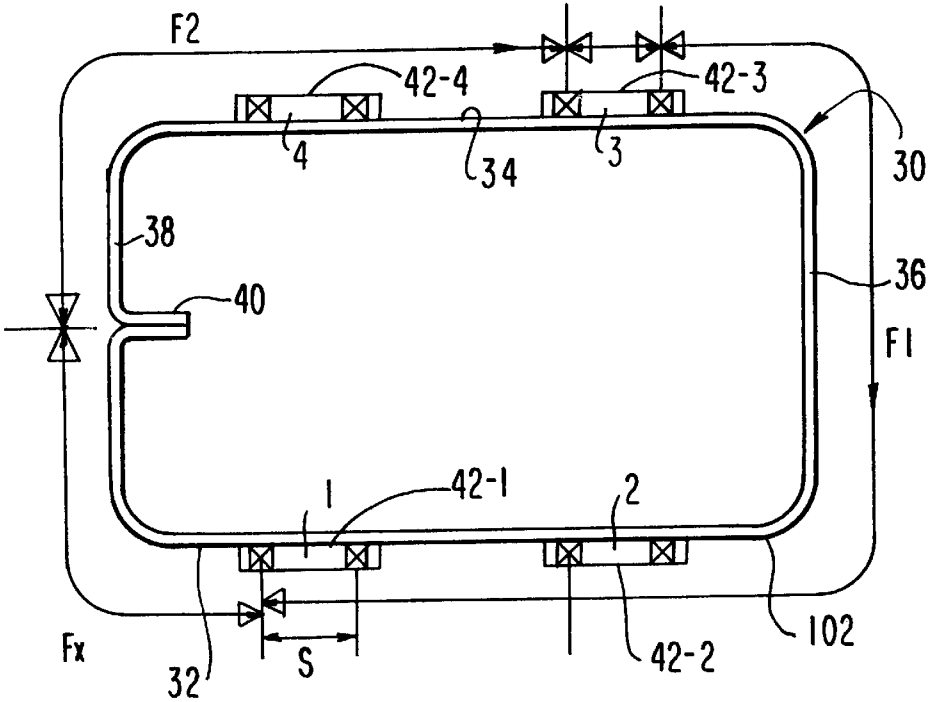
FIG. 4 is a top plan view of a complete mattress border with cloth handles installed according to the invention.

Two cloth handles 42 are attached to each of the two side panels 32, 34 as is shown in FIG. 4. The sewing area for first handles 42-1 and 42-2 is set at a metered distance from the border 30 end and the handles 42-1 and 42-2 are sewn to mattress border 30 at the same time. On completion of this operation the web 102 is advanced to place the handles 42-3 and 42-4 in the sewing devices 112 and 114 in the places formerly occupied by the handles 42-1 and 42-2, respectively. Handles 42-3 and 42-4 are now sewn to the mattress border 30. The web 102 of border 30 is now advanced and is cut at cut-off blade 110 (See FIG. 5). The ends 40 of the web 102 are joined when the border 30 is attached to the mattress panels.

Figure 5:
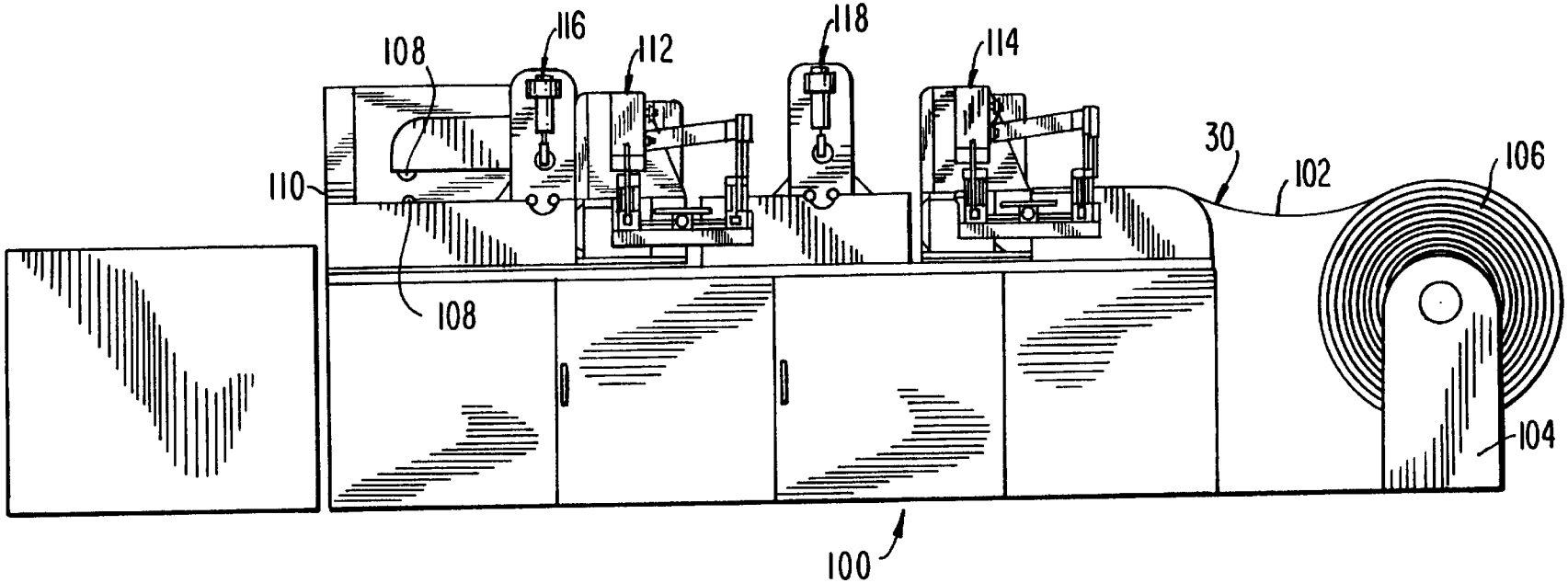
FIG. 5 is front elevational view of an automatic mattress handle sewing workstation according to the concepts of the invention.
Figure 6:
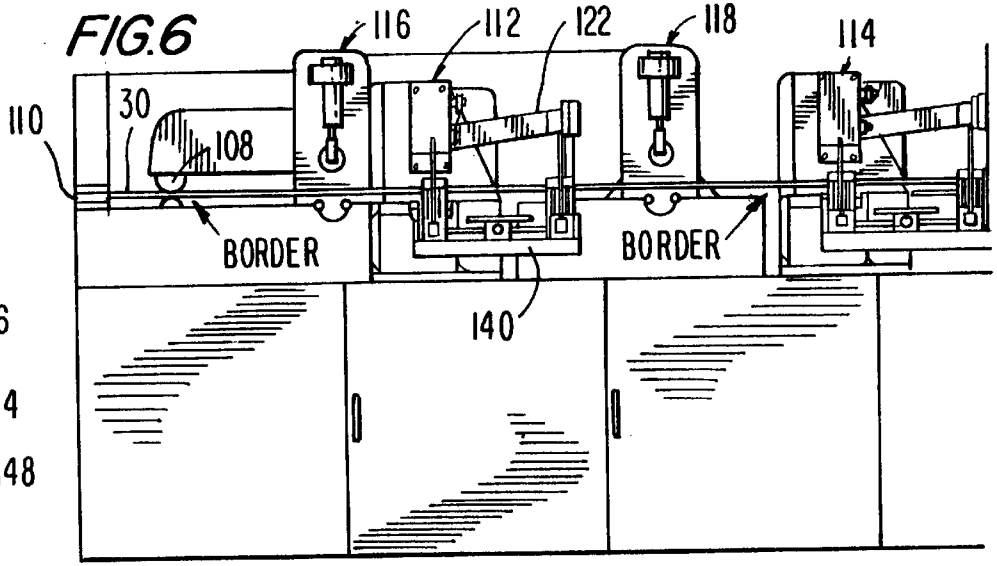
FIG. 6 is similar to FIG. 5 but shows a mattress border web in the workstation.

Turning now to FIGS. 5 and 6 the general layout of an automatic mattress handle sewing workstation 100 constructed in accordance with the concepts of the invention is shown. A continuous web 102 of mattress border 30 is feed from a supply roller 106 supported by a yoke 104. The web 102 is feed along and supported by the various portions of workstation 100. The web 102 is payed off of roller 106 and advanced along the workstation 100 by means of selectively controlled rollers 108. Adjacent rollers 108 is a cut-off blade 110 to sever a completed border from the web 102 of border material 30. A first sewing device 112 is used to sew a first cloth handle 42-1 to the border 30 and a second sewing device 114 is used to sew a second cloth handle 42-2 to the border 30. The spacing between the first and second sewing devices 112 and 114. respectively, determines the span between the two handles 42 on each portion of the mattress border. A slack roller device 116 is provided between sewing device 112 and the rollers 108 and a second slack roller device 118 is provided between the sewing devices 112 and 114. The slack roller devices 116 and 118 bear upon the mattress border 30 and form depressions in local areas of the mattress border 30 to provide slack in the border 30 and remove any tension in the border 30 caused by the feed rollers 108 or by the various sewing devices 112 and 114 and clamps.

Figure 8:
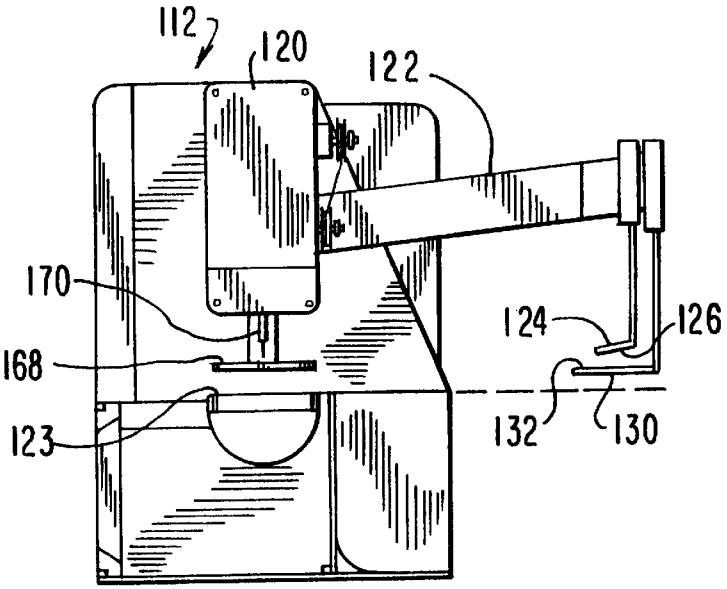
FIG. 8 is similar to FIG. 7 with the installation finger assembly removed to permit a better understanding of the instant workstation.

FIG. 7 shows the sewing device 112 with its associated clamps and the installation finger assembly 140 in the handle receiving position. FIG. 8 shows the same structure as shown in FIG. 7 but with the installation finger assembly 140 removed to expose the various clamps of the sewing device 112. A side clamp arm 122 extending from the sewing head 120 supports and positions an upper side clamp 124 which works in concert with a lower side clamp 130. Upper side clamp 124 has a lower surface 126 and lower side clamp 130 has an upper surface 132. Upper side clamp 124 will hold the sewing area 60 or the right side of handle 42 when folded over and inserted between the lower surface 126 of upper side clamp 124 and the upper surface 132 of the lower side clamp 130 against upper surface 132 of lower side clamp 130. The lower side clamp 130 will control the overall height of the inserted cloth handle 42. Both the lower side clamp 130 and the upper side clamp 124 travel along side clamp arm 122 as an assembly placing the right side 60 of each handle 42 under the sewing clamps as will be described below.

Figure 9:
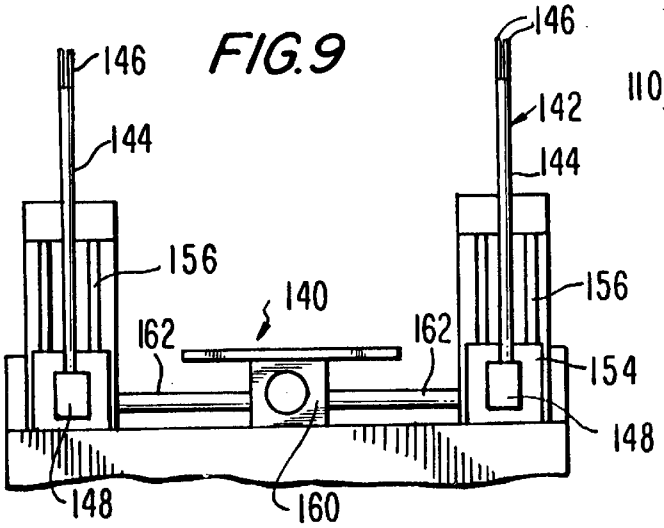
FIG. 9 is a front elevational view of the installation finger assembly of the instant workstation.
Figure 15:
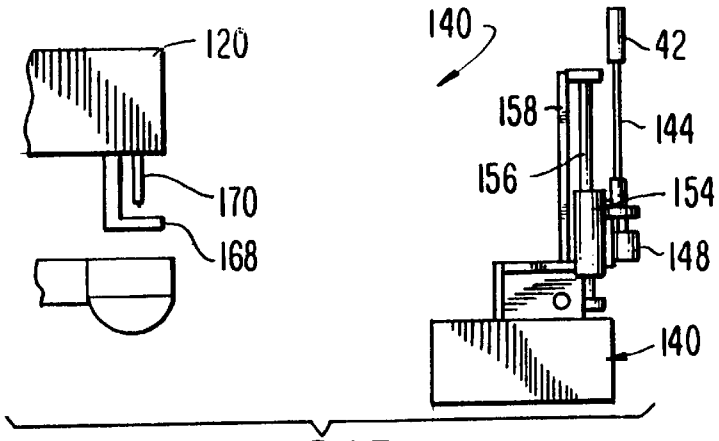
FIG. 15 is schematic left elevational view of the installation finger assembly in its initial position and shown with reference to a workstation sewing head.
Figure 14:
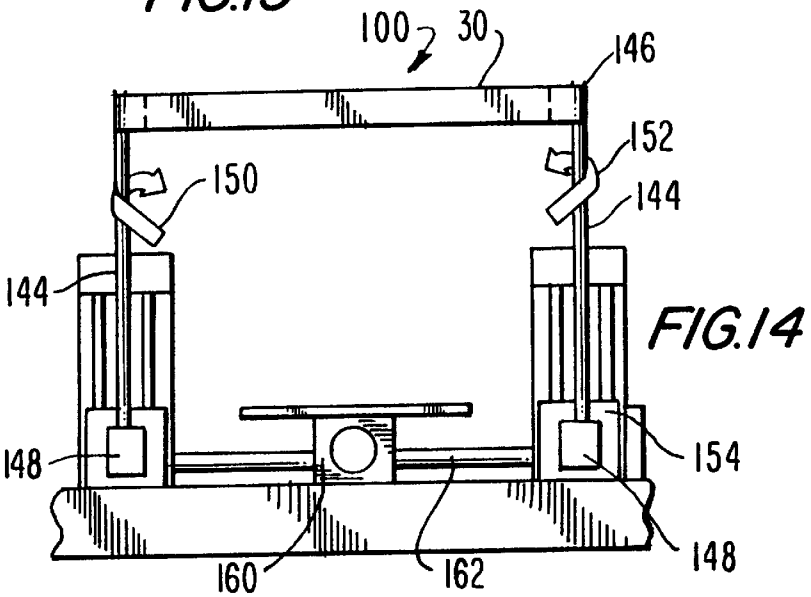
FIG. 14 is a front elevational view of the installation finger assembly rotated 180° to fold over the ends of a cloth handle upon themselves.
Figure 13:
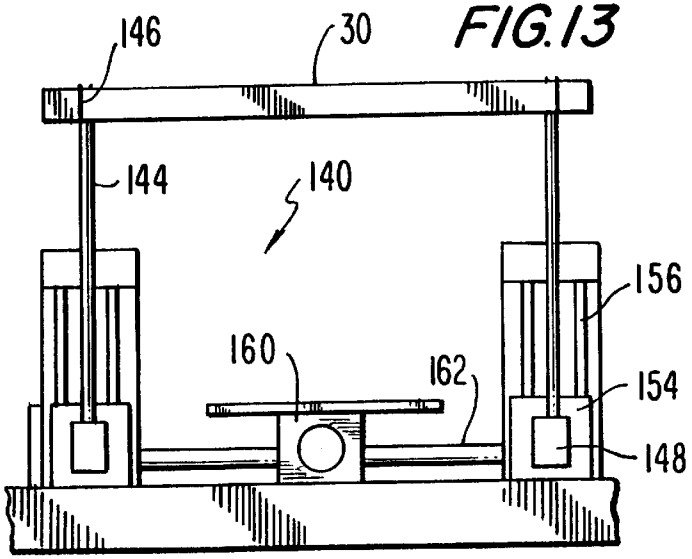
FIG. 13 is a front elevational view of the installation finger assembly as shown in FIG. 9 but with a cloth handle inserted therein.

The installation finger assembly 140 is shown in its handle receiving position in front of sewing device 112 of FIG. 7. The details of the installation finger assembly 140 and its operation is better shown in FIGS. 9 and 13 to 19 to which reference is now made. The twirler clamps 142, two for each cloth handle 42, have central shafts 144 each terminating in a pair of spaced fingers 146. The spacing between the fingers 146 permits a cloth handle 42 to be inserted there between (see FIG. 13). The other end of the shafts 144 are each coupled to a rotating cylinder 148 capable of rotating the shafts 144 through a rotation of approximately 180°. This turns the portions 54 and 56 under the remainder of the handle 42 and retains them in this condition as shown in FIGS. 14 and 15. As shown by the arrows 150, 152 the shafts 144 are turned in opposite directions. Once the handle 42 is in place as shown by FIGS. 14 and 15 the start button (not shown) can be activated to start the handle sewing process. The two twirler clamps 142 also include two linear actuators 154 which are each connected to shafts 156 which permits the fingers 146 to be extended beyond the installation finger assembly housing 158 or withdrawn within the limits of housing 158. (See FIGS. 17 and 18) A further rotary actuator 160 (see FIG. 9) is coupled by a shaft 162 to each of the two twirler clamps 142 to rotate the shafts 144 through 90° in the direction shown by arrow 164 in FIG. 16.

Figure 18:
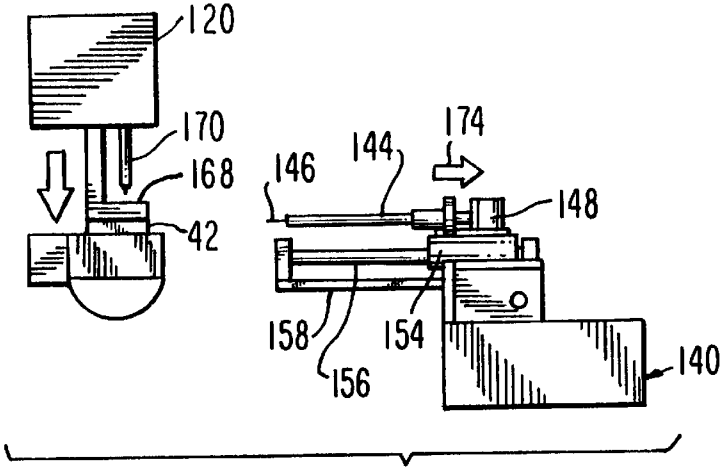
FIG. 18 is similar to FIG. 16 but shows the handle clamped in the sewing head and the installation finger assembly withdrawn.
Figure 16:
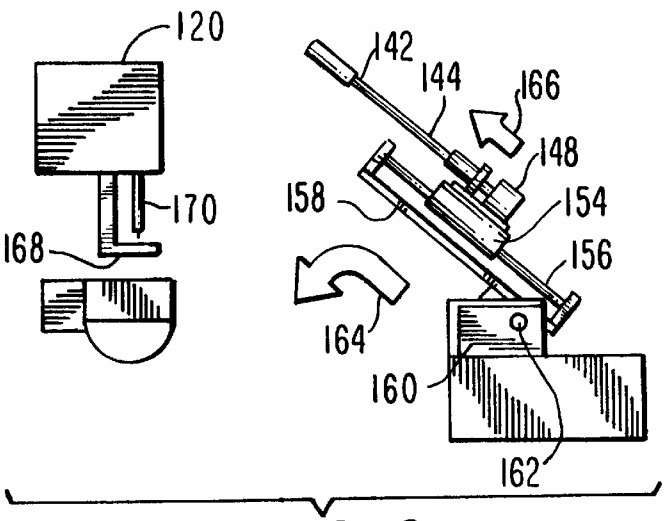
FIG. 16 is similar to FIG. 15 but shows the installation finger assembly rotating.
Figure 17:
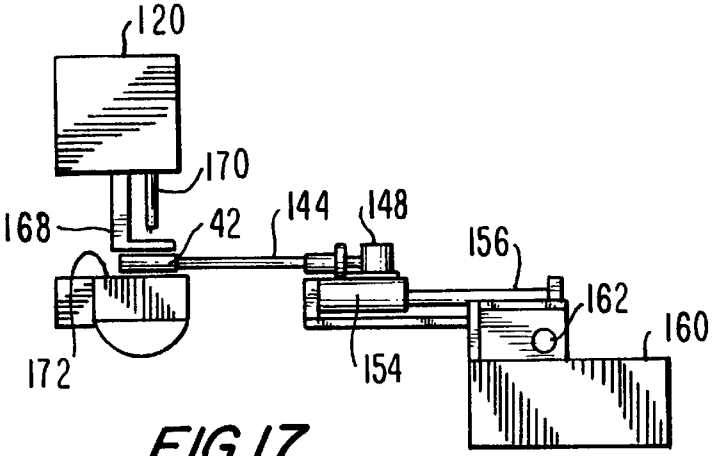
FIG. 17 is similar to FIG. 15 but shows the handle fully inserted into the sewing head.

After the twirler clamps 142 have tucked the ends of 54, 56 under the body of the handle 42, the actuator 160 is energized to drive the assembly 140 in a counterclockwise direction as shown by the arrow 164 in FIG. 16. At the same time, the linear actuators 154 are operated to move the twirler clamps 142 towards the sewing head 120 in the direction shown by arrow 166. This continues until the end area 58 of handle 42 is inserted below the sewing clamp 168. The sewing clamp 168 is made up of two U-shaped sections which are applied separately and when fully applied provide a window through which needle 170 can extend to sew a handle 42 to the border 30. The two halves of sewing clamp 168 permit some movement of the border 30 and handles 42 to remove any tension in the border 30 or the handles 42 and applying one half of clamp 168 permits the twirler clamp 142 to be withdrawn. The rotation of the feed rollers 108 is stopped during the sewing cycle so as not to apply tension to the web 102 of border 30. Also a clamp at the point where the web 102 enters the workstation (not shown) prevents the application of any tension farm the web 102. One half of the sewing clamp 168 comes down on the first edge of the handle 42 so that the handle 42 is held against border 30 but permits withdrawal of the twirler clamp 142 as shown in FIG. 18. Once the twirler clamp 142 is removed, the second half of the sewing clamp 168 is pressed against the handle 42 at left portion 58.

Figure 19:
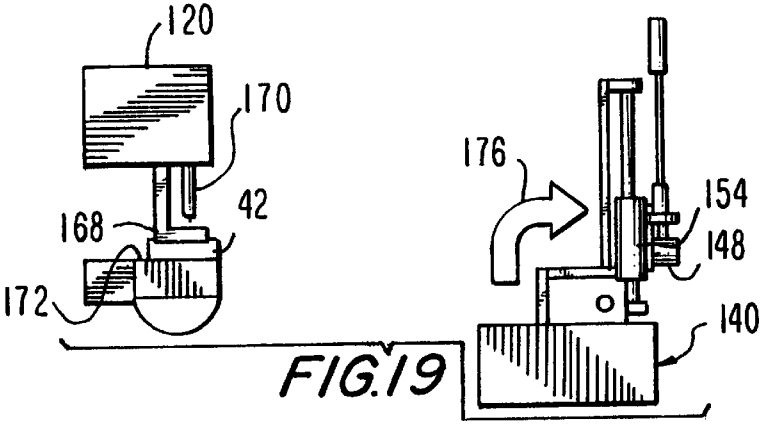
FIG. 19 is similar to FIG. 18 with the installation finger assembly in its first position to receive a cloth handle.

The actuator 154 causes the clamp shafts 144 to withdrawn (see FIG. 18 allow 174) and the arms 144 to rotate 90° in the direction shown by the arrow 176 until perpendicular as shown in FIG. 19. The actuator 148 rotates the shafts 144 until they are in a position to accept the next handle as shown in FIG. 19.

Figure 11:
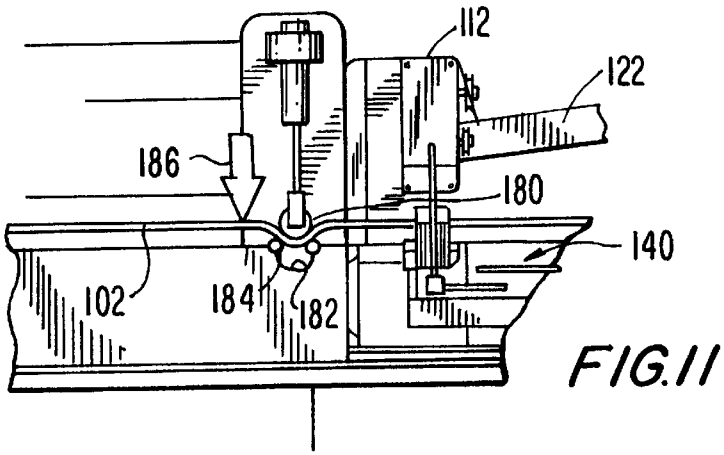
FIG. 11 is a fragmentary front elevational view of the slack generating roller operating in a first direction upon a web of mattress border.
Figure 10:
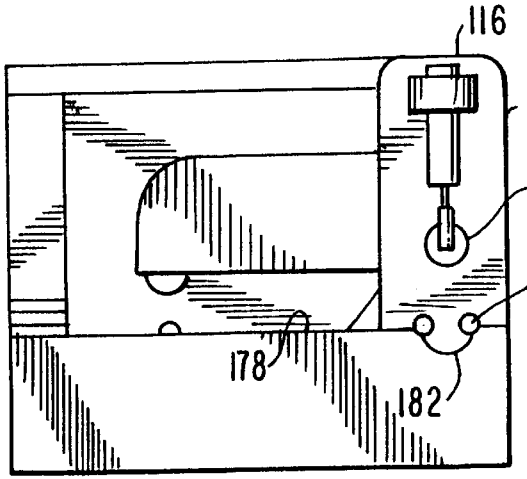
FIG. 10 is a front elevational view of a portion of the workstation of FIG. 5 showing a slack generating roller and a cut-off knife.
Figure 12:
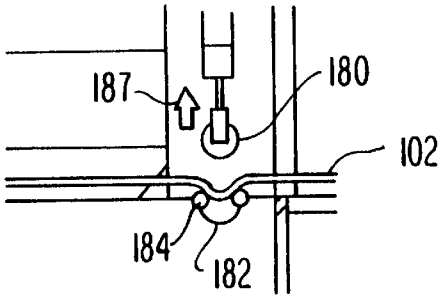
FIG. 12 is similar to FIG. 11 and shows the slack in the web of mattress border created by the slack generating roller with the roller moving away from the web.

As described, above tension can be applied to the web 102 of border 30 by the weight of the border 30 itself or by the feed rolls 108 and to some degree by the sewing itself. FIGS. 10 to 12 shown a slack roller device, such as 116 or 118 of FIG. 6, which can add some slack to the web 102. The slack roller device includes a roller 180 having a rubber or metal exterior to engage web 102 as it is moved over the surface of the workstation counter 178. Roller 180 is shown in its retracted position in FIG. 10. A recess 182 is opposite roller 180 in the workstation counter 178. The recess 182 has a pair of rollers 184 at the entry to the recess 182 to prevent tearing of the border 30 as roller 180 moves the border 30 into the recess 182. When the roller 180 moves in the direction of arrow 186 it forces a portion of the web 102 into the recess 182 over the rollers 184 as is shown in FIG. 11. The roller 180 is then withdrawn, moving in the direction of arrow 187, in FIG. 12 and leaves the bowed portion of the web 102 between the rollers 184 in recess 182. It has been found that a 1 inch diameter roller 180 will add about one inch of slack to the web 102.

Figure 22:
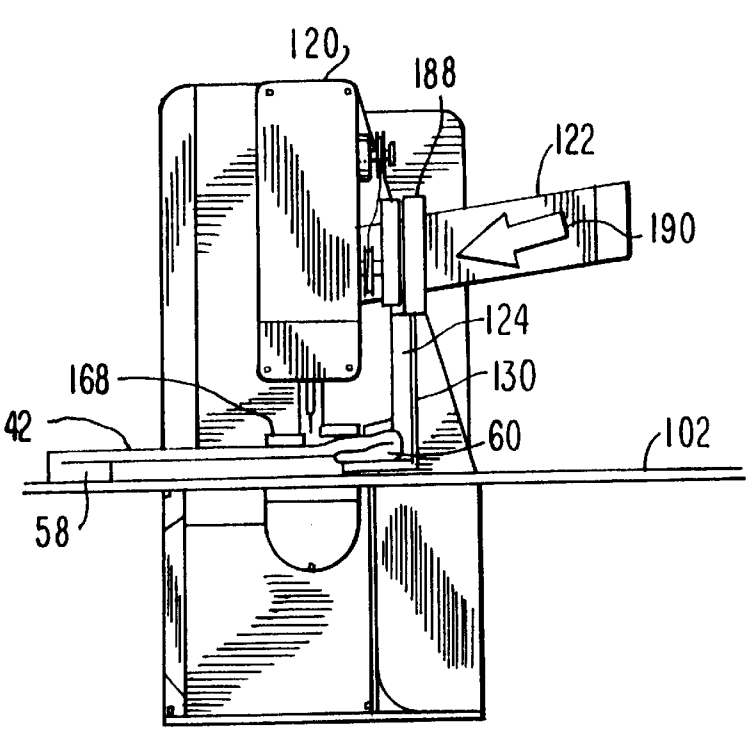
FIG. 22 is similar to FIG. 21 with the clamp assembly at its final position adjacent to the sewing head.
Figure 20:
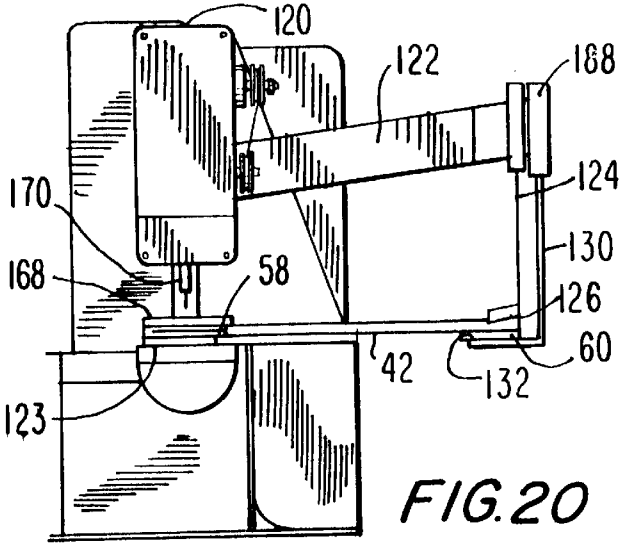
FIG. 20 is a front elevational view of a sewing head with the installation finger assembly removed to better appreciate the details of a clamp assembly.
Figure 21:
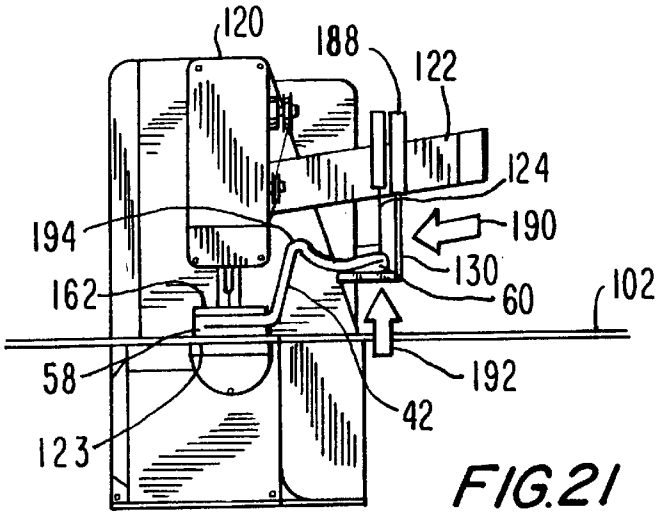
FIG. 21 is similar to FIG. 20 with the clamp assembly partially moved towards the sewing head.

Referring now to FIGS. 20, 21, and 22, the advancement of the in the inturned portion 60, that is the end of the right end 46 of cloth handle 42, into the sewing head 120 is shown. The upper side clamp 124 and the lower side clamp 130 are joined to one another at carriage 188 and move together along side clamp arm 122. As shown in FIG. 20, inturned portion 58 of handle 42, is on the dog assembly 123, as is well known in the sewing machine art, and held in place by sewing clamp 168 until the needle 170 has completed the required sewing. The needle 170 moves to its idle position remote from the handle 42. The carriage 188 begins to travel along side the clamp arm 122 towards sewing head 120 as shown by the arrow 190. The carriage 188 is also elevated in the direction of the arrow 192. Since the handle 42 is still held on its left side 44 by sewing clamp 168, the movement of the carriage 188 causes the handle 42 to bulge as at 194 (see FIG. 21). Now the sewing clamp 168 is released and the web 102 advanced. The budge 194 straightens out and the inturned end 60 of handle 42 is presented to the sewing head 120. The handle 42 is not made completely flat against the mattress border 30. Some slack is provided so that a hand can fit between the handle 42 and the mattress can be turned or positioned on a bed. The left portion of sewing clamp 168 presses the handle 42 against the mattress border web 102. The upper side clamp 124 and the lower side clamp 130 are released and carriage 188 moves them to the right in FIG. 22 to their initial position as shown in FIG. 20. The right portion of sewing clamp 168 now engages the handle 42 and sewing may begin.

Although the sewing of only the left cloth handle 42-1 is described it should be understood that handles 42-1 and 42-2 (by sewing device 114) are sewed at the same time and in the same steps as described above. Once this sewing is completed the web 102 is moved to a position to receive handles 42-3 and 42-4 in the sewing devices 112 and 114, respectively. The sewing operation is completed and the web 102 is advanced to the cut-off blade 110 which servers the completed mattress border 30 from the web 102. The described operations begin again on the next length of border web 102.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the inventions.

I claim:

1. An automatic mattress sewing work station for sewing cloth handles to a continuous web of mattress border comprising:

a) a sewing device having two sewing heads for sewing each end of two two ended cloth handles to a web of mattress border;

b) an installation finger assembly, said assembly having two twirler clamps, one for each end of a cloth handle and positioned adjacent ends of said handle, said installation finger assembly and said clamp means are duplicated to permit two handles to be sewn to the mattress border at one time;

c) said two twirler clamps of each of said two installation finger assemblies each having a first position to receive a handle therebetween and a second position wherein said respective ends of each of said handles are bent under a main body of said handles;

d) said two installation finger assemblies each further comprising positioning means to position said handles adjacent said web of mattress border; and e) clamp means one for each of said two sewing heads for holding said handles with said bent under ends against said web of mattress border while each of said sewing heads sews one of said handles to said web of mattress border.

2. An automatic mattress handle sewing work station for sewing cloth handles to a continuous web of mattress border comprising:

a) a sewing device having at least one sewing head for sewing each end of a two ended cloth handle to a web of mattress border;

b) an installation finger assembly, said assembly having two twirler clamps, one for each end of a cloth handle and positioned adjacent ends of said handle;

c) said two twirler clamps, each having a first position to receive a handle therebetween and a second position wherein said respective ends of said handles are bent under a main body of said handle;

d) said installation finger assembly further comprising positioning means to position said handles adjacent said web of mattress border; and e) clamp means for holding said handles with said bent under ends against said web of mattress border while said sewing head sews said handles to said web of mattress border;

f) each of said clamp means comprises:

g) a first U-shaped member having a body portion and two parallel legs;

h) a second U-shaped member having a body portion and two parallel legs, the free ends of the parallel legs of said second U-shaped member being aligned with the free ends of the parallel legs of said first U-shaped member to form an enclosed rectangular area for admitting a sewing needle of said sewing head to said handle and mattress border.

3. An automatic mattress handle sewing workstation, as defined in claim 2, wherein said first U-shaped member and said second U-shaped member can be applied to said handle and mattress border independently.

4. An automatic mattress handle sewing workstation for sewing cloth handles to a continuous web of mattress border comprising:

a) a sewing device having two sewing heads for sewing each end of two two ended cloth handles to a web of mattress border;

b) an installation finger assembly, said assembly having two twirler clamps, one for each end of a cloth handle and positioned adjacent ends of said handle;

c) said two twirler clamps having a first position to receive a handle therebetween and a second position wherein said respective ends of said handles are bent under a main body of said handle;

d) said installation finger assembly further comprising positioning means to position said handles adjacent said web of mattress border; and e) clamp means for holding said handles with said bent under ends against said web of mattress border while said sewing head sews said handles to said web of mattress border;

f) each of said two sewing heads further comprises:

g) a lower side clamp having a top surface;

h) an upper side clamp having a bottom surface;

i) said handle in said second position with the inturned end and the handle end held between said top surface of said lower side clamp and said bottom surface of said upper side clamp.

5. An automatic mattress handle sewing workstation, as defined in claim 4, wherein said lower side claim and said upper side clamps are coupled to a single, common carriage to permit said lower and upper side clamps to move together.

6. An automatic mattress handle sewing workstation, as defined in claim 5, wherein said sewing device further comprises a side clamp arm extending from each of said at least one sewing head to receive said carriage and control the position thereof between said at least one sewing head and an end of said side clamp arm whereby a second end of said handle in said second position can be moved to said at least one sewing head.

7. An automatic mattress handle sewing workstation for sewing cloth handles to a continuous web of mattress border comprising:

a) a plurality of cloth handles, each having a first end, a second end and a body therebetween;

b) a continuous web of mattress border;

c) a first sewing device having a first sewing head for sewing said first and second ends of a first handle to said web of mattress border;

d) a second sewing device having a second sewing head for sewing said first and second ends of a second handle to said web of mattress border, said second handle spaced from said first handle along said web of mattress border;

e) two installation finger assemblies, one for each of said first and second sewing devices, each of said assemblies having two twirler clamps, one for each of said first and second ends of a cloth handle and positioned adjacent the first and second ends of said handles;

f) each of said four twirler clamps having a first position to receive a handle between associated pairs of said twirler clamps and a second position wherein said first and second ends of a handle are bent under an associated handle body;

g) said installation finger assemblies further comprising positioning means, one for each of said two installation assemblies to position said handles adjacent said web of mattress border; and h) two sets of clamping means, one for each of said two sewing devices for holding first and second handles with said first and second bent under ends against said web of mattress border while said sewing heads sew said first and second ends of each of said first and second handles to said web of mattress border.

8. An automatic mattress handle sewing workstation, as defined in claim 7, wherein each of said two installation finger assembles further have first means coupled to said two twirler clamps to turn them between said first and second positions.

9. An automatic mattress handle sewing workstation, as defined in claim 8, wherein the two twirler clamps of each installation finger assembly are turned in opposite directions.

10. An automatic mattress handle sewing workstation, as defined in claim 8, wherein each of said installation finger assembles further have a second means to move said assembly from a first position perpendicular to said mattress border to a second position parallel with said mattress border.

11. An automatic mattress handle sewing workstation, as defined in claim 10, wherein each of said installation finger assembles further has a third means to move said twirler clamps and said handles to a position under said sewing head and said clamps means.

12. An automatic mattress handle sewing workstation, as defined in claim 11, further comprising:

a) synchronizing means coupled to said first, second and third means whereby all of said first means, said second means and said third means operate at the same time.

13. An automatic mattress handle sewing workstation, as defined in claim 7, wherein each of said two sets of clamping means comprise:

a) a first U-shaped member having a body portion and two parallel legs; and b) a second U-shaped member having a body portion and two parallel legs, the free ends of the parallel legs of said second U-shaped member being aligned with the free ends of the parallel legs of said first U-shaped member to form an enclosed rectangular area for admitting a sewing needle of said sewing heads to said handle and mattress border.

14. An automatic mattress handle sewing workstation, as defined in claim 13, wherein said first U-shaped member of each clamping means and said second U-shaped member can be applied to said handle and mattress border independently.

15. An automatic mattress handle sewing workstation, as defined in claim 7, wherein each of said first and second sewing heads further comprise:

a) a lower side clamp having a top surface;

b) an upper side clamp having a bottom surface;

c) said second end of said handle in said second position with the inturned end and the second end of said handle held between said top surface of said lower side clamp and said bottom surface of said upper side clamp.

16. An automatic mattress handle sewing workstation, as defined in claim 15, wherein each of said lower side clamps and said upper side clamps are each coupled to a single, common carriage to permit one of said lower side clamps and its associated one of said upper side clamps to move together.

17. An automatic mattress handle sewing workstation; as defined in claim 16, wherein each of said sewing devices further comprises:

a) a side clamp arm extending from each of said first and second sewing heads to receive said carriage and control the position thereof between said associated first and second sewing heads and a free end of said associated side clamp arm whereby a second end of said handle in said second position can be moved to said associated sewing head.

* * * * *